US006327937B1

(12) United States Patent
Ibarra

(10) Patent No.: US 6,327,937 B1
(45) Date of Patent: Dec. 11, 2001

(54) WRENCH

(76) Inventor: Santiago Ibarra, 1011 N. Grant St., Liberal, KS (US) 67901

( * ) Notice: Subject to any disclaimer, the term of this patent is extended or adjusted under 35 U.S.C. 154(b) by 0 days.

(21) Appl. No.: 09/729,206

(22) Filed: Dec. 5, 2000

(51) Int. Cl.[7] ..... B25B 33/00
(52) U.S. Cl. ..... 81/55; 81/13
(58) Field of Search ..... 81/13, 55

(56) References Cited

U.S. PATENT DOCUMENTS

| | | |
|---|---|---|
| 447,706 | 3/1891 | Vernon . |
| 615,273 | 12/1898 | Higdon . |
| 1,208,449 | 12/1916 | Attwasser . |
| 1,260,698 | 3/1918 | Moore et al. . |
| 1,406,824 | 2/1922 | Dennis . |
| 2,394,027 | 2/1946 | Vlass . |
| 2,454,027 | 11/1948 | Baeza . |
| 3,277,749 | 10/1966 | Osburn et al. . |
| 3,731,559 | 5/1973 | Krupke . |

FOREIGN PATENT DOCUMENTS

| | | |
|---|---|---|
| 516713 | 9/1955 | (CA) . |

*Primary Examiner*—James G. Smith
(74) *Attorney, Agent, or Firm*—Stephen R. Greiner

(57) ABSTRACT

A wrench including an elongated body with a pair of primary socket members attached to the opposed ends thereof. Each of the primary socket members has a driven socket for holding and turning a nut. A sliding sleeve is slidably and rotatably positioned on the body. A retaining arm extends outwardly from the sliding sleeve and carries an extensible backup assembly. The backup assembly has a support bracket releasably secured to the retaining arm and carrier bracket suspended from the support bracket by at least one spring. The carrier bracket has a threaded aperture with which a threaded rod is engaged. A secondary socket member is attached to the threaded rod and has a backup socket for holding a nut in axial alignment with one in the driven socket.

3 Claims, 1 Drawing Sheet

WRENCH

FIELD OF THE INVENTION

The present invention relates generally to tools and, more particularly, to bolt holders.

BACKGROUND OF THE INVENTION

Removing the oversized, threaded fasteners from the flanges found on wellheads in oilfield environments is especially difficult. Not only is the work backbreaking, often requiring that a sledgehammer be swung repeatedly at a specialized wrench to turn the fasteners, but it is dangerous since done in the presence of pressurized and highly flammable fluids. Unfortunately, many individuals have suffered physical injury performing this particular task. A need, therefore, presently exists for a tool that permits flange fasteners to be removed with ease and safety.

SUMMARY OF THE INVENTION

In light of the problems associated with the prior art, it is a principal object of the invention to provide a wrench for use in oilfield settings that will grip, say, nuts on opposite ends of a bolt and turn one of the nuts while holding the other motionless. The wrench works in conjunction with the hydraulic tongs on a workover rig. The tongs supply torque to the wrench to either tighten or loosen a selected nut or other threaded fastener. It is believed that such a wrench will save time and reduce injuries.

It is an object of the invention to provide improved elements and arrangements thereof in a wrench for the purposes described which is lightweight in construction, inexpensive to manufacture, and dependable in use.

Briefly, the wrench in accordance with this invention achieves the intended objects by featuring an elongated body with a pair of drive dogs affixed to its opposed ends. A pair of primary socket members is releasably attached to the drive dogs for holding and turning a first nut. A pair of spaced-apart collars encircles the body and a sliding sleeve is slidably and rotatably positioned on the body therebetween. A retaining arm extends from the sliding sleeve and carries an extensible backup assembly. The backup assembly has a support bracket releasably secured to the retaining arm and a carrier bracket attached to the support bracket by means of a spring. The carrier bracket has a threaded aperture from which a threaded rod extends. A secondary socket member is attached to the threaded rod and has a pair of backup sockets for selectively holding a second nut in axial alignment with the first nut.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
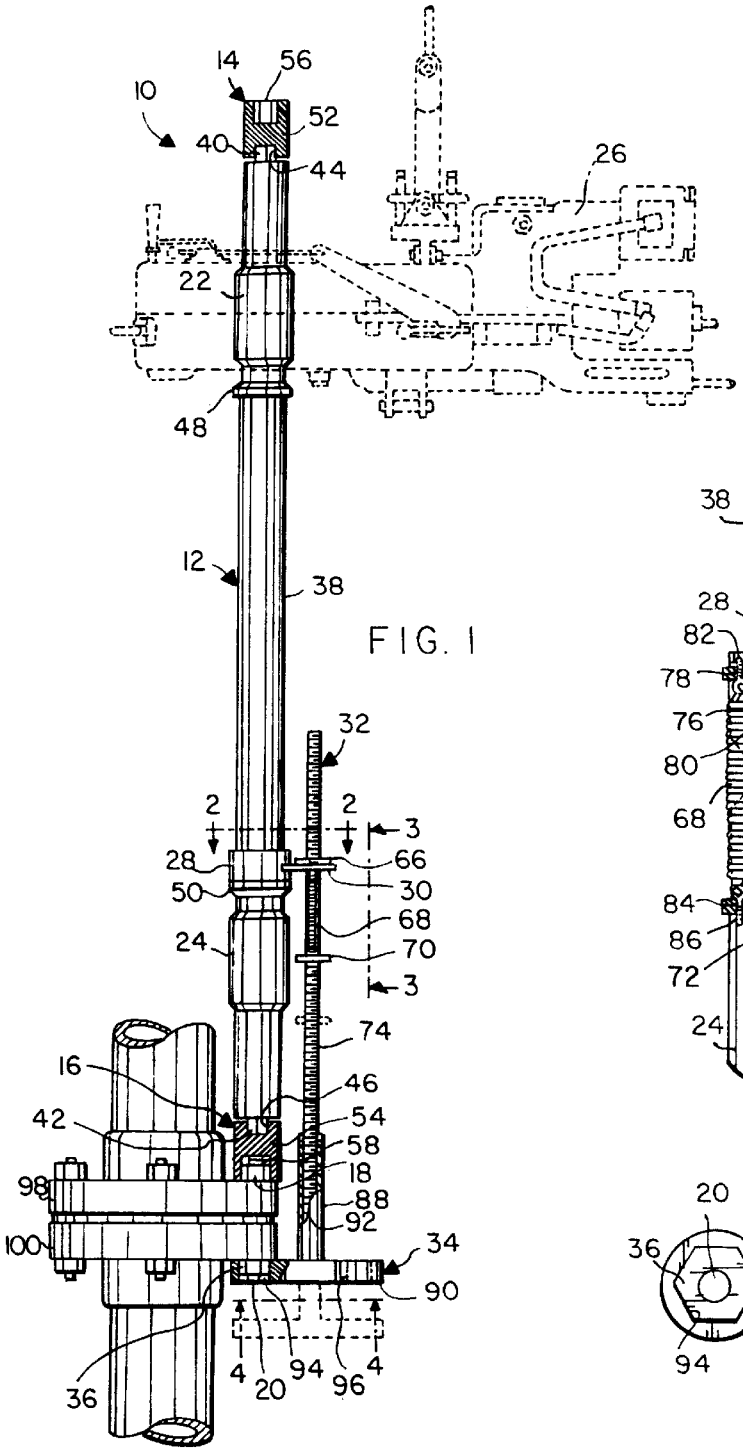
FIG. 1 is a side view of a wrench in accordance with the present invention and with portions broken away to reveal details thereof shown holding a threaded fastener on a wellhead flange and being grasped by hydraulic tongs for rotation of the wrench.
Figure 2:
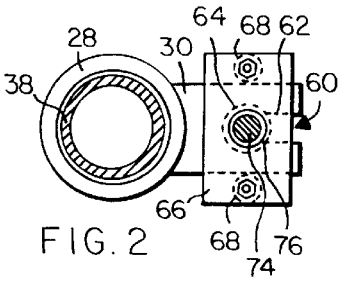
FIG. 2 is an enlarged, cross-sectional view taken along line 2—2 of FIG. 1.
Figure 3:
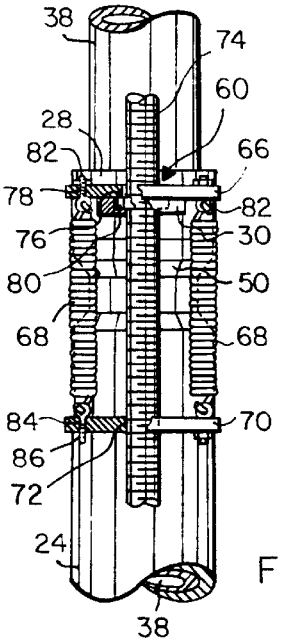
FIG. 3 is an enlarged view of a front portion of the wrench taken along line 3—3 of FIG. 1.
Figure 4:
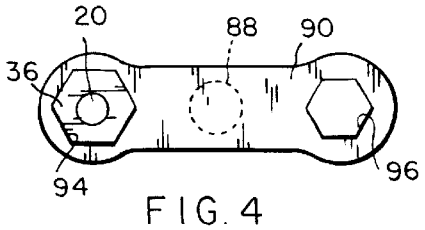
FIG. 4 is an enlarged view of a bottom portion of the wrench taken along line 4—4 of FIG. 1.

Referring now to the FIGS., a wrench in accordance with the present invention is shown at 10. Wrench 10 includes an elongated body 12 carrying primary socket members 14 and 16 at its opposite ends for engaging threaded fasteners like nut 18 atop bolt 20. Collars 22 and 24 are provided on body 12 adjacent socket members 14 and 16 for grasping by hydraulic tongs 26. A sliding sleeve 28 is positioned on body 12 between collars 22 and 24. A retaining arm 30 extends outwardly from sleeve 28 and releasably holds an extensible backup assembly 32 having at its bottom a secondary socket member 34 for engaging a nut 36 on the bottom of bolt 20. When tongs 26 turn body 12, nut 18 may be rapidly and easily unscrewed with socket member 34 serving as a backup to prevent rotation of bolt 20.

Body 12 includes a piece of stiff, metallic pipe 38 about 50 inches (127 cm) long and 2.25 inches (5.7 cm) in diameter. Drive dogs 40 and 42 are welded to the opposite ends of pipe 38 and are adapted for snug yet releasable insertion into complementary drive sockets 44 and 46 in primary socket members 14 and 16. About 6 inches (15 cm) from each end of pipe 38 collars 22 and 24, measuring 4.5 inches (11.4 cm) in length and 2.875 inches (7.3 cm) in diameter, are welded in place for the reinforcement of pipe 38. Welded to pipe 38 between collars 22 and 24 and about 25 inches (64 cm) apart is a pair of stop rings 48 and 50. Each of the stop rings 48 and 50 measures about 0.375 inches (1 cm) in length and 2.875 inches (7.3 cm) in diameter and serves as an abutment for sliding sleeve 28.

Primary socket members 14 and 16 include cylindrical bodies 52 and 54 having driven sockets 56 and 58 in their ends opposite those having drive sockets 44 and 46. In the preferred embodiment, driven sockets 56 and 58 are hexagonal in outline and measure, respectively, 1.625 inches (4.1 cm) and 1.8125 inches (4.6 cm) across their flats. Of course, the configurations and dimensions of sockets 56 and 58 may be varied in accordance with need.

Sliding sleeve 28 travels freely on body 12 between stop rings 48 and 50. Preferably, sleeve 28 is 1.5 inches (3.8 cm) in length and has a 2.875-inch (7.3-cm) outer diameter. The inner diameter of sleeve 28 is larger than that of pipe 38 yet smaller than that of the stop rings 48 and 50.

Retaining arm 30 is a metallic plate measuring about 2.5 inches (6.4 cm) in length, 2 inches (5 cm) in width and 0.25 inches (0.64 cm) in thickness. Arm 30 is welded at its inner end to the side of sleeve 28. In the outer end of arm 30 is provided a keyhole slot 60. As shown, slot 60 has an outer portion 62 with a length and width of about 0.56 inches (1.4 cm) and a circular inner portion 64 with a diameter of 0.875 inches (2.2 cm).

Extensible backup assembly 34 includes a support bracket 66 for positioning atop retaining arm 30. Suspended from support bracket 66 by a pair of springs 68 is a carrier bracket 70 having a threaded aperture 72 in its center. The upper end of a threaded rod 74 extends through aperture 72 and may be adjustably positioned therein. Onto the lower end of rod 74 is threaded the secondary socket member 34.

Support bracket 66 is a metallic plate measuring about 3.25 inches (8.3 cm) in length, 1.75 inches (4.4 cm) in width and 0.25 inches (0.64 cm) in thickness. A principal opening 76 having a diameter of about 0.875 inches (2.2 cm) in diameter is provided in the center of bracket 66 and a pair of secondary openings 78 having diameters of 0.125 inch (0.32 cm) is provided on the opposite sides of opening 76. A tubular guide sleeve 80 having an outer diameter of 0.875 inches (2.2 cm) and a length of 0.5 inches (1.3 cm) is pressed into opening 76 and welded in place so as to extend downwardly from bracket 66. The inner diameter of guide sleeve 80 is sufficiently large so that rod 74 may pass freely through guide sleeve 80.

Suspended from secondary openings 78 are eye bolts 82 or cotter pins (not shown) from the looped, lower ends of which springs 68 are suspended. Each spring 68 is about 5 inches (12.7 cm) in length and 0.25 inches (0.64 cm) in diameter in its unstretched state. When placed under a light tension as will be described below, springs 68 may elongate by several inches.

Carrier bracket 70 is a metal plate having substantially the same overall dimensions as support bracket 66. Bracket 70 has a threaded aperture 72 with a diameter of 0.5625 inches (1.43 cm) at its center and a pair of secondary openings 84 having diameters of 0.125 inch (0.32 cm) is provided on the opposite sides of aperture 72. In openings 84 are eye bolts 86 or other fasteners attaching bracket 70 to the bottoms of springs 68.

Threaded rod 74 is 25 inches (64 cm) in length and 0.5625 inches (1.43 cm) in diameter. The upper end of rod 74 is threaded into aperture 72 of bracket 70. In fact, when threaded into aperture 72 to a great enough extent, rod 74 penetrates principal opening 76 of bracket 66.

Secondary socket member 34 is threaded onto the lower end of rod 74. Socket member 34 includes an attachment portion 88 welded at right angles to the center of a backup portion 90. Attachment portion 88 is a tube 6.5 inches (16.5 cm) long and 1 inch (2.5 cm) in diameter with a threaded interior passageway 92 0.5625 inches (1.43 cm) in diameter for threaded engagement with rod 74. Backup portion 90, however, is a plate measuring about 7.5 inches (19 cm) long, 2.5 inches (6.4 cm) wide and 1 inch (2.5 cm) thick. The opposite ends of backup portion 90 are provided with backup sockets 94 and 96 that may be selectively axially aligned with either socket 56 or socket 58. Sockets 94 and 96 are hexagonal in outline and measure, respectively, 1.625 inches (4.1 cm) and 1.8125 inches (4.6 cm) across their flats. Like sockets 56 and 58, the configurations and dimensions of sockets 94 and 96 may be varied.

Use of wrench 10 is straightforward. First, primary socket member 42 on one end of body 12 is positioned atop nut 18 joining wellhead pipe flanges 98 and 100 together. Then, support bracket 66 is set atop retaining arm 30 with guide sleeve 80 inserted within portion 64 of slot 60 to join extensible backup assembly 32 to body 12. Next, secondary socket member 34 is pulled downwardly against the force of springs 68 to locate socket member 34 at the broken line position of FIG. 1. Upon releasing socket member 34, springs 68 will elevate such into abutment with the bottom of flange 100 thereby fixing nut 36 within socket 94 of backup portion 90. Tongs 26 suspended from a conventional workover rig (not shown) are, now, engaged in the usual manner with collar 22 and caused to rotate body 12 counterclockwise to unscrew nut 18 from bolt 20. Secondary socket member 34 prevents bolt 20 and nut 36 from turning with nut 18. Thus, all threaded fasteners joining flanges 98 and 100 together can be removed quickly, safely, and with great ease.

It should be apparent that tightening a nut such as 18 is accomplished with equal ease. The steps outlined above are performed in the same manner. Tongs 26 are caused to rotate in the opposite direction. Should tongs 26 not be available, a pipe wrench or other torque generating tool may be applied to either of collars 22 or 24 to rotate body 12 with good results in turning nuts 18.

If socket 58 were too large to grip nut 18, body 12 may be inverted to engage socket 56 with nut 18. Similarly, secondary socket member 34 can be rotated to bring socket 96 into engagement with nut 36 for a better fit. Thus, the two nut sizes most frequently encountered by a user can always be accommodated by wrench 10. Substitutes for socket members 14, 16, and 34 with sockets of less commonly used sizes can be carried separately in a toolbox and selectively attached to drive dogs 40 or 42 or rod 74 when needed.

While the invention has been described with a high degree of particularity, it will be appreciated by those skilled in the art that modifications may be made thereto. For example, tabs may be provided to the underside of backup portion 90 to prevent threaded fasteners like nut—from falling through sockets 94 and 96 and onto the ground. Therefore, it is to be understood that the present invention is not limited to the sole embodiment described above, but encompasses any and all embodiments within the scope of the following claims.

I claim:

1. A wrench, comprising:

an elongated body having opposed ends;

a pair of primary socket members each being respectively attached to one of said opposed ends of said elongated body, each of said primary socket members having a driven socket for holding and turning a first nut;

a sliding sleeve slidably and rotatably positioned on said elongated body between said primary socket members;

a retaining arm attached to, and extending outwardly from, said sliding sleeve;

an extensible backup assembly carried by said retaining arm, said backup assembly including:

a support bracket releasably secured to said retaining arm;

a spring suspended from said support bracket;

a carrier bracket attached to said spring at a distance from said support bracket, said carrier bracket having a threaded aperture;

a threaded rod extending from said carrier bracket and in threaded engagement with said threaded aperture; and, a secondary socket member on said threaded rod and having a backup socket for holding a second nut, and said backup socket being selectively movable into axial alignment with either of said driven sockets.

2. A wrench, comprising:

an elongated body having opposed ends;

a pair of drive dogs each being respectively affixed to one of said opposed ends of said elongated body;

a pair of primary socket members each being respectively and releasably attached to one of said drive dogs, each of said primary socket members having a driven socket for holding and turning a first nut;

a pair of collars encircling said elongated body and being spaced at a fixed distance from one another;

a sliding sleeve slidably and rotatably positioned on said elongated body between said collars;

a retaining arm attached to, and extending outwardly from, said sliding sleeve;

an extensible backup assembly carried by said retaining arm, said backup assembly including:

a support bracket releasably secured to said retaining arm;

a spring suspended from said support bracket;

a carrier bracket attached to said spring at a distance from said support bracket, said carrier bracket having a threaded aperture;

a threaded rod extending from said carrier bracket and in threaded engagement with said threaded aperture; and, a secondary socket member on said threaded rod and having a backup socket for holding a second nut, and said backup socket being selectively movable into in axial alignment with either of said driven sockets.

3. A wrench, comprising:

an elongated body having opposed ends;

a pair of drive dogs each being respectively affixed to one of said opposed ends of said elongated body;

a pair of primary socket members each being respectively and releasably attached to one of said drive dogs, each of said primary socket members having a driven socket for holding and turning a first nut;

a pair of collars encircling said elongated body and being spaced at a fixed distance from one another;

a sliding sleeve slidably and rotatably positioned on said elongated body between said collars;

a retaining arm attached to, and extending outwardly from, said sliding sleeve, said retaining arm having a keyhole slot therein with an outer portion and a relatively wider inner portion;

an extensible backup assembly carried by said retaining arm, said backup assembly including:

a support bracket removably positioned atop said retaining arm, said support bracket having a principal opening and a tubular guide sleeve extending downwardly from said principal opening, said tubular guide sleeve being snugly positionable within said inner portion of said keyhole slot;

a pair of springs suspended from said support bracket;

a carrier bracket attached to said springs at a distance from said support bracket, said carrier bracket having a threaded aperture;

a threaded rod extending from said carrier bracket and in threaded engagement with said threaded aperture, said threaded rod being sized for free movement through said tubular guide sleeve and said outer portion of said keyhole slot; and, a secondary socket member on said threaded rod and having a pair of backup sockets each for holding and turning a second nut, and said backup sockets being selectively movable into in axial alignment with either of said driven sockets.

* * * * *